US009033167B1

(12) United States Patent
Pineda et al.

(10) Patent No.: US 9,033,167 B1
(45) Date of Patent: May 19, 2015

(54) AUTOMATIC PACING SYSTEM FOR A BABY BOTTLE

(71) Applicant: Preemie-Pacer, LLC, O'Fallon, MO (US)

(72) Inventors: Roberta Pineda, St. Louis, MO (US); Alyssa Abramoski, Canton, MI (US); William Forrester, Concord, CA (US); Rebecca Salisbury, Broomfield, CO (US)

( * ) Notice: Subject to any disclaimer, the term of this patent is extended or adjusted under 35 U.S.C. 154(b) by 0 days.

(21) Appl. No.: 14/205,574

(22) Filed: Mar. 12, 2014

Related U.S. Application Data

(60) Provisional application No. 61/777,312, filed on Mar. 12, 2013.

(51) Int. Cl.
*A61J 9/00* (2006.01)

(52) U.S. Cl.
CPC ..... *A61J 9/00* (2013.01)

(58) Field of Classification Search
USPC ..... 215/11.4, 11.5; 222/555, 560; 239/33; 137/511–543
See application file for complete search history.

(56) References Cited

U.S. PATENT DOCUMENTS

| | | | | |
|---|---|---|---|---|
| 4,339,046 | A * | 7/1982 | Coen | 215/11.5 |
| 5,150,800 | A * | 9/1992 | Sarter et al. | 215/11.4 |
| 5,791,503 | A * | 8/1998 | Lyons | 215/11.5 |
| 6,033,367 | A | 3/2000 | Goldfield | |
| 6,659,302 | B2 * | 12/2003 | Lin | 220/254.8 |
| 6,966,904 | B2 | 11/2005 | Ruth et al. | |
| 2001/0002011 | A1 * | 5/2001 | Tebeau | 215/11.4 |
| 2011/0266245 | A1 | 11/2011 | Lau | |

FOREIGN PATENT DOCUMENTS

WO 2012174315 A1 12/2012

* cited by examiner

*Primary Examiner* — Anthony Stashick
*Assistant Examiner* — Raven Collins
(74) *Attorney, Agent, or Firm* — Lewis Rice LLC

(57) ABSTRACT

An insert which is useable with a baby bottle, a baby bottle including an insert, and a method of feeding an infant that serves to pace the infant's feeding rhythm. Generally, these devices and methods will be of use for a preterm infant, but that is by no means limiting because full term infants could also benefit from these devices and methods. The device generally cues the infant to swallow and breathe after each 1-4 sucks by stopping the flow of the fluid from the bottle after the infant has sucked sufficiently. Once the baby breathes, the bottle resets for the next repetition.

2 Claims, 6 Drawing Sheets

AUTOMATIC PACING SYSTEM FOR A BABY BOTTLE

CROSS REFERENCE TO RELATED APPLICATIONS

This application claims benefit of U.S. Provisional Patent Application No. 61/777,312, filed Mar. 12, 2013, the entire disclosure of which is incorporated herein by reference.

BACKGROUND OF THE INVENTION

1. Field of the Invention

This disclosure is related to the field of devices and methods for providing intermittent flow in a vessel, particularly intermittent flow in a baby bottle to assist in teaching preterm infants to successfully eat.

2. Description of the Related Art

The average gestation period of a human being is generally considered to be 280 days, or around 40 weeks, from fertilization. Recent science has indicated that birth, without any medical intervention, will, on average, occur at a little over 38 weeks after fertilization. However, for the most part, medicine considers an infant born from 37-42 weeks after conception to be "full term." A large number of babies, however, are born prior to this period. In the United States around 12% of babies born each year are considered to be "preterm," that is, before the $37^{th}$ week. Some of these births occur naturally, some occur due to complications in pregnancy, and others are sometimes scheduled early due to the need for planned Cesarean section births, [from induced labor due to lab results], or from concern that an infant is getting too large to be easily delivered.

Regardless of the reason that an infant is born preterm, preterm infants (and even those born in the $38^{th}$ and $39^{th}$ week compared to those born later) generally have more medical issues at birth than full term infants. For example, infant mortality rates for preterm infants are generally double those of full term infants. Another problem associated with preterm babies is that they have trouble learning how to eat. The act of nursing (or alternatively eating from a bottle) generally requires an infant to follow a pattern usually referred to as "suck-swallow-breathe." In this pattern, an infant sucks once, swallows once, breathes once, and then repeats. Preterm infants, however, may feed with repetitions of 3 or 4 (or more) sucks and swallows and 1 breathing break. However, many preterm infants have trouble maintaining any pattern and an inability to feed can lead to further complications with the infant; this can result in increased medical expense because of the need to keep them at a hospital.

Because many preterm infants (and particularly very early preterm infants) are maintained in a Neonatal Intensive Care Unit (NICU), they are often bottle fed (breastfeeding is a challenge) and effective feeding patterns must be imposed until the central nervous system matures to enable coordination of the suck-swallow-breathe pattern. NICU nurses and therapists currently manually pace preterm infants during bottle feeding, and parents are often taught how to pace preterm infants during oral feeds. It has been found that many preterm infants will continue sucking until prompted to swallow and breathe by the feeder. During feeding, monitors attached to the infants in the NICU collect data regarding respiration, heart rate and other vital signs to assist the nurse in knowing when to prompt the infant to swallow and breathe. However, these monitors often take longer to alert a nurse than desired. This requires the nurse to analyze the infant's facial features for signs of stress, such as raised eyebrows, breathing difficulty, or blue discoloration.

When the NICU nurse detects that the infant needs to breathe, the nurse tilts or, if necessary, completely removes the bottle to stop the flow of liquid from the bottle. This cues the infant to swallow and begin breathing again. This system is highly subjective to human intervention and requires constant attention during feeding to minimize the possibility of risks such as choking or aspiration. Many infants will eventually pick up the rhythm of suck-swallow-breathe after only a few repetitions, and it is desirable for infants that quickly pick up the pattern to begin pacing naturally as that allows them to maintain their own pattern and maintain their own pace while maximizing the amount of intake. Removing or maneuvering the bottle can often cause problems with the infant establishing a pattern, gaining an adequate swallow on fluid that has been expressed, and/or re-establishing the feeding response. Therefore it is desirable to provide a more simplified solution for establishing an eating pattern.

SUMMARY

The following is a summary of the invention which should provide to the reader a basic understanding of some aspects of the invention. This summary is not intended to identify critical components of the invention, nor in any way to delineate the scope of the invention. The sole purpose of this summary is to present in simplified language some aspects of the invention as a prelude to the more detailed description presented below.

Because of these and other problems in the art, it is desirable to provide a feeding device that eliminates the need to constantly monitor a feeding in a preterm infant and manually alter the flow of liquid in a bottle.

Described herein, among other things, is an insert which is useable with a baby bottle, a baby bottle including an insert, and a method of feeding an infant that serves to pace the infant's feeding rhythm. Generally, these devices and methods will be of use for a preterm infant, but that is by no means limiting because full term infants could also benefit from these devices and methods. The device generally cues the infant to swallow and breathe after each 1-4 sucks by stopping the flow of the fluid from the bottle after the infant has sucked sufficiently. Once the baby breathes, the bottle resets for the next repetition. In order to pace a preterm infant, the device will generally detect the pressure the baby is applying to the liquid in the bottle and then automatically stop the flow. The flow will stop for an adequate time for the infant to be cued to swallow and breathe. In an embodiment, the flow is discontinued after sufficient sucks by the infant, and will not resume until the infant stops sucking on the nipple of the bottle, indicating the infant has picked up on the cue to swallow and breathe.

There is described herein, in an embodiment, a pacing valve for use with a baby bottle, the valve comprising: a base having a plurality of holes therethrough; a turbine having a plurality of channels therethrough, the turbine being rotational mounted to the base so that the channels are intermittently aligned and misaligned with the holes; and a spring, the spring biasing the rotational mounting so that the channels are aligned with the holes; wherein, the pacing valve is placed between a main body and a nipple of a baby bottle; and wherein, an infant sucking on the nipple will move fluid from the main body to the nipple and cause the turbine to rotate relative to the base.

In an embodiment of the valve, as the turbine rotates from the fluid moving therethrough, the channels become misaligned with the holes.

In an embodiment of the valve, when the channels are misaligned the fluid flow through the channel ceases.

In an embodiment of the valve, when the infant ceases sucking, the spring rotates the turbine to align the channels with the holes.

There is also described herein, a baby bottle for feeding a preterm infant, the bottle comprising: a main body for holding fluid; a nipple; a connector ring; and a pacing valve, the valve including: a base having a plurality of holes therethrough; a turbine having a plurality of channels therethrough, the turbine being rotational mounted to the base so that the channels are intermittently aligned and misaligned with the holes; and a spring, the spring biasing the rotational mounting so that the channels are aligned with the holes; wherein, the pacing valve is placed between the main body and the nipple and the pacing valve and the nipple are attached to the main body by the connector ring such that fluid flowing from the main body to the nipple will cause the turbine to rotate.

In an embodiment of the bottle, as the turbine rotates from the fluid moving therethrough, the channels become misaligned with the holes.

In an embodiment of the bottle, when the channels are misaligned the fluid flow through the channel ceases.

There is also described herein a method of feeding an infant from a bottle, the method comprising: providing a baby bottle including a pacing valve between a main body and a nipple, the pacing valve including: a base having a plurality of holes therethrough; a turbine having a plurality of channels therethrough, the turbine being rotational mounted to the base so that the channels are intermittently aligned and misaligned with the holes; and a spring, the spring biasing the rotational mounting so that the channels are aligned with the holes; having an infant suck on the nipple to flow fluid from the main body to the nipple, the fluid flow causing the turbine to rotate relative to the base; as the turbine rotates, decreasing the fluid flow through the pacing valve; and when the infant ceases sucking on the nipple, increasing the fluid flow through the pacing valve.

DESCRIPTION OF THE PREFERRED EMBODIMENT(S)

Figure 1A:
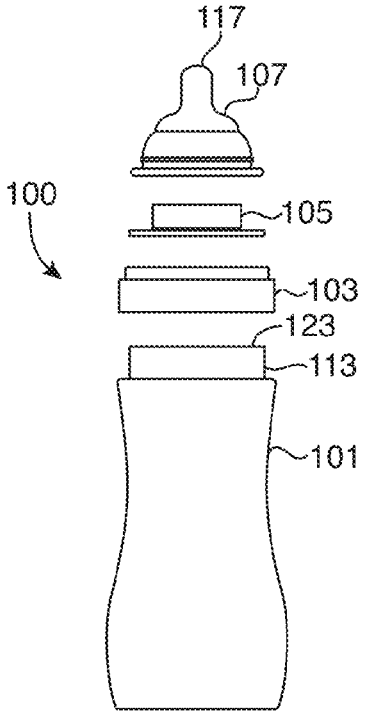
FIGS. 1A, 1B, and 1C provide an exploded view, assembly side view, and perspective view, respectively, of an embodiment of a baby bottle including a pacing valve.

The following detailed description and disclosure illustrates by way of example and not by way of limitation. This description will clearly enable one skilled in the art to make and use the disclosed systems and apparatus, and describes several embodiments, adaptations, variations, alternatives and uses of the disclosed systems and apparatus. As various changes could be made in the above constructions without departing from the scope of the disclosures, it is intended that all matter contained in the above description or shown in the accompanying drawings shall be interpreted as illustrative and not in a limiting sense.

A normal NICU feeding bottle contains about 30-40 millimeters of solution in a generally cylindrical bottle (100) as shown in FIG. 1. While there is some variation among baby bottles, those used in any particular NICU are generally of a particular type and most are broadly similar. It is preferable that the feeding control be provided without needing to fundamentally alter the baby bottle (100) or having to provide a specialized bottle as that requires NICU nurses to utilize a particular baby bottle for all infants, which can be undesirable. Further, while the device is primarily for use by medical personnel, parents can be present and may need to continue the same feeding pattern at home. Thus, a feeding device needs to be simple to use, replicate its function regardless of the user, be dependable to minimize a chance of failure or further frustration for the infant, and be usable and effective for a variety of ranges of strength and feeding styles of preterm infants.

Further, because of its use in both a hospital and home setting, while in an embodiment the device may be disposable and single use, the device can preferably be provided sterile, be re-sterilizable, and is ideally easily washable, preferably in a standard dishwasher.

FIG. 1 provides an embodiment of an insert in the form of a pacing valve (105) for use with an infant bottle (100) that serves to provide for intermittent flow. The bottle (100) is of standard design and comprises a main body (101), which is used to house milk, formula, or another liquid product for feeding the infant, a nipple (107) upon which the infant sucks in order to pull fluid from the main body, and a connecting ring (103) which serves to hold the nipple (107) in place on the bottle (100). In a traditional operation, the main body (101) is filled with fluid, the nipple (107) is seated inside the connecting ring (103), and the connecting ring is screwed onto a mating screw ring (113) on the main body. The bottle is then inverted (placing the nipple (107) below the main body (101)). Fluid flows from the main body (101) into the nipple and is held in place inside the nipple (107).

The nipple will generally include at least one hole at its distal end (117) through which the fluid can pass. For very young infants, the hole is usually sufficiently small that the surface tension of the fluid will not allow it to pass through without pressure being applied. An infant is fed by placing the nipple (107) in their mouth. They will generally instinctually suck on the nipple (107) pulling the fluid through the hole and into their mouth. For an infant that has suck-swallow-breathe activity, once the infant has sufficient fluid in their mouth, they will cease sucking on the nipple (107) and swallow. They will then breathe, which may relax the pressure generated in the nipple (107).

In the embodiment of FIG. 1, in order to assist with the suck-swallow-breathe activity, there is a pacing valve (105) placed in the connecting ring (103) under the nipple. As seen in FIG. 1, the pacing valve (105) is designed to seat behind and partially within the structure of the nipple and will generally be held in place by the connecting ring (103). Because of its position, fluid in the main body (101) has to pass through the pacing valve (105) in order to go from the main body to the nipple (107).

Figure 1B:
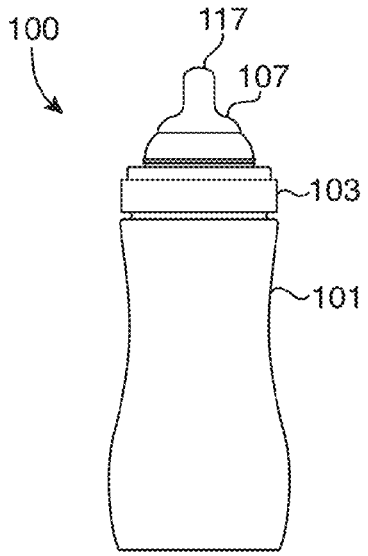
Figure 1C:
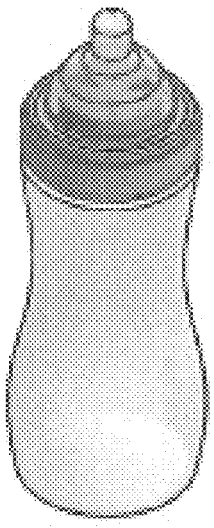
Figure 2A:
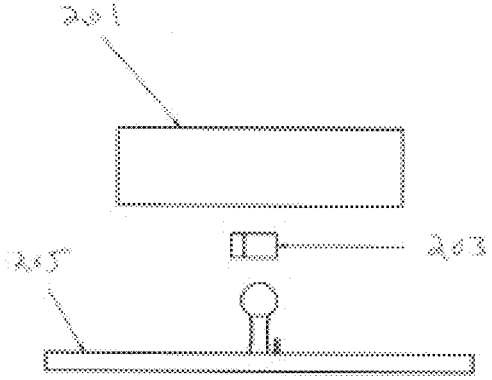
FIGS. 2A, 2B, and 2C provide a exploded view, assembly side view, and perspective view, respectively, of an embodiment of a pacing valve.
Figure 2B:
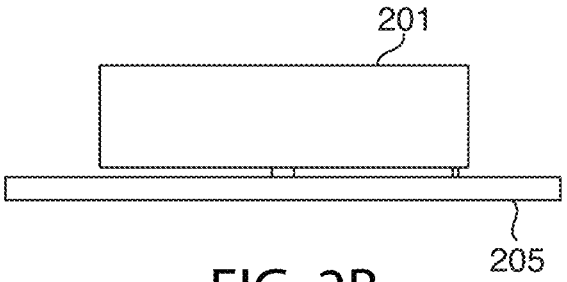
Figure 2C:
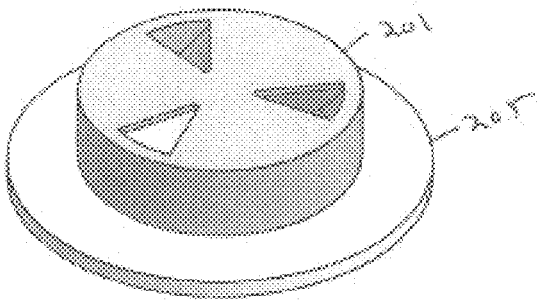
Figure 3:
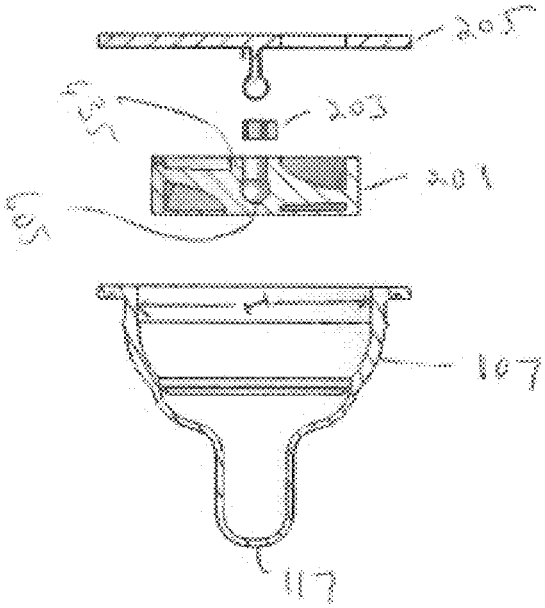
FIG. 3 provides a side sectional exploded view of the components of an embodiment of a pacing valve and bottle nipple.

The pacing valve (105) of FIGS. 1A-1C, and as shown in the embodiment of FIGS. 2A-2C, comprises three major components. A base (205), a spring (203) and a turbine (201). The spring (203) is shown in detail in FIGS. 5A-5C and comprises a rotary spring. The spring (203) attaches to the turbine (201), which is shown in greater detail in FIGS. 6A-6E, and the base (205), which is shown in greater detail in FIGS. 4A-4C. The turbine (201) and base (205) snap together around the spring (203) to complete the system. As can be seen in FIG. 1, the pacing valve (105) is designed to fit within the connecting ring (103) of a standard NICU, or any other, baby bottle (100). FIG. 3 provides some additional detail showing the pacing valve (105) in an exploded sectioned view seated behind a nipple (107).

In operation, the turbine (201) rotates through a controlled arc and includes openings (601) which are either aligned, or misaligned, with openings (401) in the base (205). When the two sets of openings (401) and (601) are aligned (open state), fluid can flow from the main body (101), through the base (205), through the turbine (201) and into the nipple (107). When the openings (401) and (601) are misaligned (closed state), fluid is restrained at the pacing valve (105) and cannot enter the nipple (107). The turbine (201) alternates between open and closed states with the base due to the fluid flow induced by the infant sucking on the nipple (107) and spring dynamics. The closed state stops flow to allow the infant to swallow and breathe. The open state allows fluid to flow into the nipple for the infant to feed.

Figure 4A:
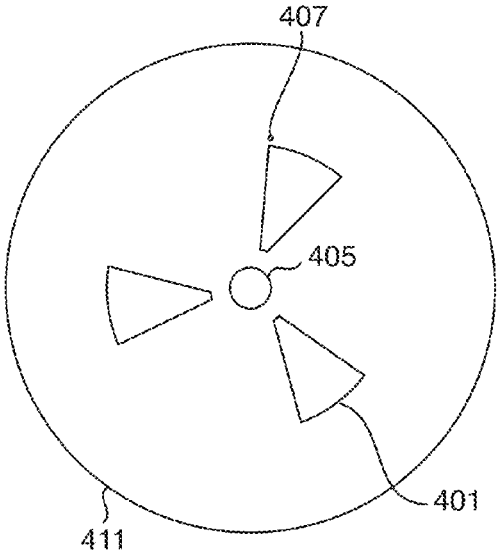
FIGS. 4A, 4B, and 4C provide a top view, side view, and perspective view, respectively, of an embodiment of a disk for a pacing valve.
Figure 4B:
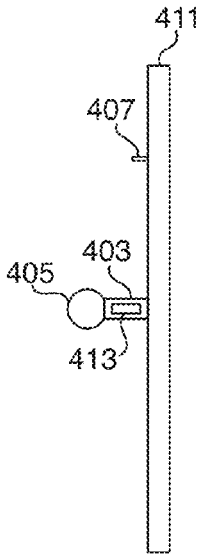
Figure 4C:
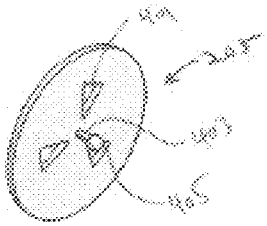

FIGS. 4A-6E provide for additional detail of the pacing valve (105) structure. The base (205), as seen in FIGS. 4A-4C comprises a generally circular platform (411) with a plurality of holes (401) therethrough. There are three holes (401) in the depicted embodiment with each hole comprising a generally triangular arc, equally spaced from the others. However, none of the number, shape, or arrangement of the holes is required. The platform (411) is in the form of a generally flat disk and is sized and shaped to cover the opening of the main body (101) of the bottle (100). The platform (411) preferably has a relatively small thickness to avoid interfering with the nipple's (107) ability to mount to the connector ring (103) or the connector ring (103) to screw onto the main body (101).

An elongated rod (403) protrudes from generally the center of one side of the platform (411) and is arranged towards the distal end (117) of the nipple (107). The distal end of the rod (403) terminates in a ball (405). This ball (405) comprises half of a ball and socket joint with the joint (605) being located on the turbine (201). This arrangement allows the turbine (201) to rotate about the axis of the rod (403). A hollow slot (413) runs through the diameter of the rod (403). The slot (413) will be used to allow for the spring (203) to be attached and rigidly held in position relative to the rod (403). To limit the rotation of the turbine (201) to a fixed arc, a second elongated rod (407) projects out of the same side of the platform (411) as the elongated rod (403). This second rod (407) is positioned nearer the edge of the platform (411) and will slide into a track (607) in the turbine (201) to limit the rotation of the turbine (201) about the rod (403) to a fixed distance.

Figure 5A:
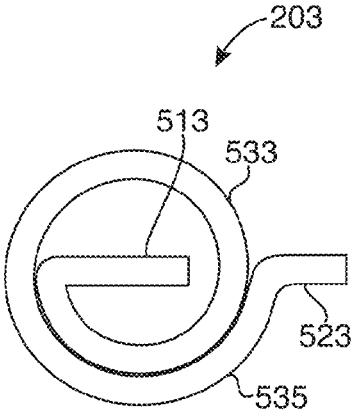
FIGS. 5A, 5B, and 5C provide a top view, side view, and perspective view, respectively, of an embodiment of a spring for a pacing valve.
Figure 5B:
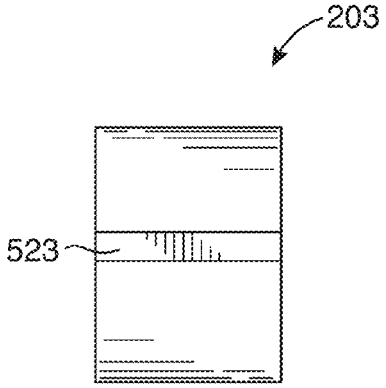
Figure 5C:
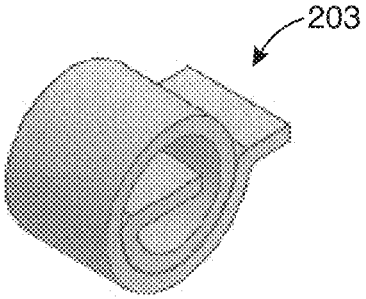

An embodiment of the spring (203) is shown in FIGS. 5A-5C, the spring (203) comprises a curled piece of plastic, metal, or another material which serves to provide a rotational return force. Specifically, it will serve to return the spring (203) to the arrangement of FIGS. 5A-5C if the legs (513) and (523) are shifted relative to each other in the plane of the page in FIG. 5A. The spring (203) joins the turbine (201) and base (205), storing energy from rotation of the turbine (201) for later use.

Figure 7:
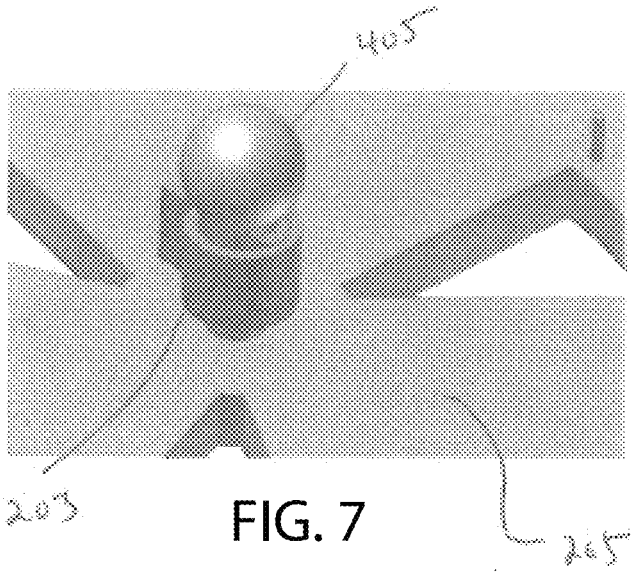
FIG. 7 depicts a perspective view of the embodiment of the spring from FIGS. 5A-5C in place on the base of FIGS. 4A-4C.

The spring (203) connects to the base (205) as is best shown in FIG. 7. The spring (203) coils around its own perimeter in larger and larger radii. Two rotations are shown in FIG. 5A, however, more or fewer can be used in different embodiments. Each end of the spring (203) forms a leg (513) and (523) to attach to the base (205) and turbine (201), respectively. The inner radius (533) of the spring (203) wraps around the rod (403) and is secured to the rod (403) by threading the leg (513) through a hollow slot (413). The outer radius (535) fits within the turbine's (201) central cylinder (635) which is the lower portion of the joint (605). The leg (523) protrudes into a slot (623) within the body (641) of the turbine (201). As the turbine (201) rotates (in either direction) it loads the spring (203).

In the preferred manner of operation, the turbine would rotate so as to move the leg (523) in the counter-clockwise direction as seen in FIG. 5A which causes the outer diameter (535) and inner diameter (533) of the spring (203) to decrease. As the spring "coils," it is loaded and the spring's biasing force will serve to return the spring to the arrangement of FIG. 5A. The spring constant, wire thickness, and dimensions are variable, as would be understood by one of ordinary skill in the art, and in an embodiment, multiple different springs of different biasing force, tension, and other properties may be provided. Specifically, different pacing valves (105) with different springs (203) may be provided. In this way, it can be constructed so that different sucking strengths are required to rotate the turbine. Thus, babies with a particularly strong suck response, who could rotate a weaker spring too quickly, can be provided with a stronger spring. In order to identify the particular strength of a particular pacing valve (105), the valves may be color coded or include indices (e.g. numbers or letters) to indicate their relative strengths.

FIGS. 6A-6E provides for an embodiment of the turbine (201). The turbine (201) of this embodiment has a body (641) of generally cylindrical shape with an outer diameter (D) slightly smaller than the inner diameter (I) of the nipple (107), and thus also smaller than the diameter (B) of the platform (411). This allows the turbine (201) to rotate freely within the nipple (107), on the platform (411), and inside the connector ring (103). The turbine (201) is placed above the platform (411) and the joint (605) fits snugly onto the ball (405) at the end of the rod (403), forming a standard ball joint.

The turbine may be generally solid with pathways therethrough or may be generally hollow. Regardless, an outer perimeter wall (643) of the turbine (201) encases the turbine blades (621) and fits within the nipple (107). The perimeter wall connects a bottom faceplate (645) and a top faceplate (647). This can be best seen in the exploded view of the parts in FIG. 3. Each of the bottom faceplate (645) and top faceplate (647) includes a hole (611A) and (611B). The holes are generally of the same size, shape and orientation to the holes (401) in the base (411) and are arranged to be offset with each other when the bottom (645) and top (647) of the faceplate are connected by the outer perimeter wall (643).

It should be noted that the ball (405) and socket (605) attachment should have minimal friction so that the turbine (201) can rotate as freely as possible about the rod (403). Further, although the ball (405) and socket (605) joints allow for larger ranges of motion than may be desired, the turbine (201) will be limited to circumferential rotation by the connection to the spring (203). This type of attachment also allows for easy assembly and disassembly, such as for cleaning.

Figure 6A:
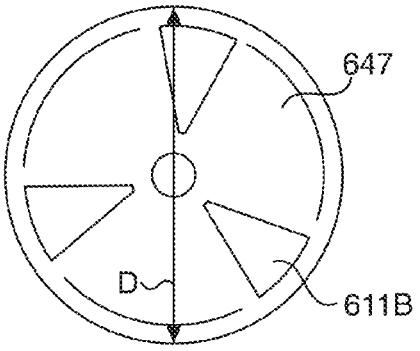
FIGS. 6A, 6B, 6C, 6D, and 6E provide a top view, side view, bottom view, side sectional view (along the line A-A in FIG. 6C), and perspective view, respectively, of an embodiment of a turbine from a pacing valve.
Figure 6B:
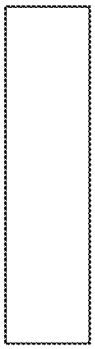
Figure 6C:
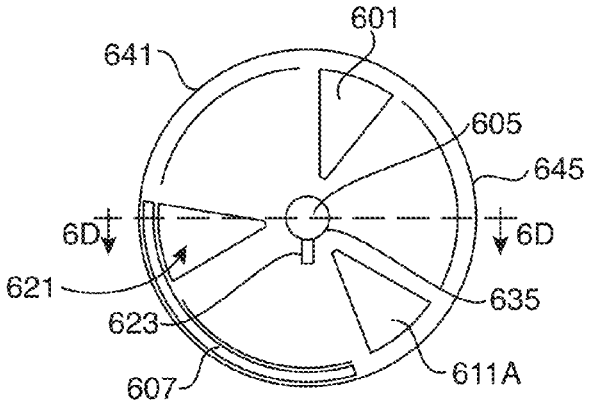
Figure 6D:
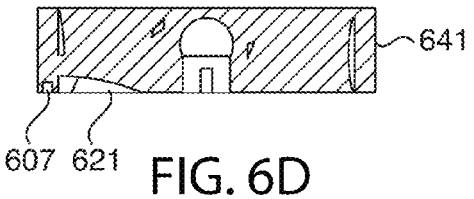
Figure 6E:
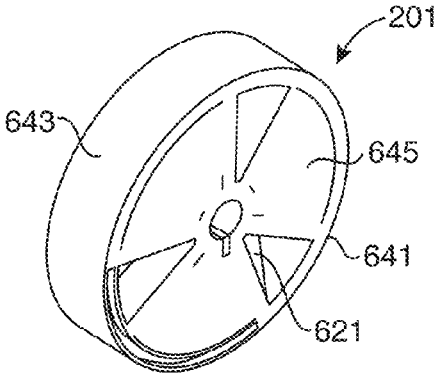

There is a track (607) which cuts through the bottom face plate (645) towards the outer perimeter (643). This track (607) houses the second rod (407) on the platform (411) and restricts the turbine (201) to about 120 degree maximum rotation. This track (607) preferably aligns with one set of open turbine blades as described below. In this way, the turbine is inhibited from movement that would allow more than one opening (601) to align with any particular opening (401). The track (607) is best seen in FIG. 6E.

The outer perimeter ring (643) secures the tip of the internal turbine blades (621). Each blade (621) is set at an angle relative to the bottom faceplate (645) and the top faceplate (647). This angle may be any angle known to one of ordinary skill but is preferably between 30 and 60 degrees relative to the bottom faceplate (645), more preferably around 45 degrees and even more preferably about 47 degrees. Each blade (621) is preferably equally spaced around the turbine and rotates about the axis at about 30°. Each blade (621) will connect one of the holes (611B) with one of the holes (611A) effectively forming an angled channel through the turbine (201), which is referred to as hole (601). In addition, there may be positioned additional turbine blades (621) insides the structure of the main body (641) to reduce the weight of the turbine (201).

In an embodiment, nine turbine blades (621) are used with six of the turbine blades (621) being internal to the main body (641) and not allowing flow into the turbine (201). Two such closed turbine blades (621) are placed between each open turbine blade (621). This is the main mechanism to restrict fluid flow through the pacing valve (105) as fluid can only flow through the channels/holes (601). Finally, there is a hollow cylinder (635) surrounding the center axis of the turbine (201) and located as a hub for the turbine blades (621). This cylinder extends from the bottom faceplate (645) towards the top faceplate (647) and terminates in a hollow spherical opening forming joint (605). This hollow cylinder (635) houses the rod (403) and spring (203) and acts as the socket for ball (405). A hollow slot (623) runs the length of the cylinder (635) to hold leg (523) of the spring (203) in place. The turbine can then rotate about its central axis with its motion resisted by the spring (203) and constrained by the second pin (407) and slot (607) arrangement.

The final assembly of the three pieces is best shown in FIGS. 2A, 3, and 7. It involves placing the spring (203) about the rod (403) and threading the inner leg (513) of the spring (203) through the elongated slot (413). The outer leg (523) of the spring would then thread into the slot (623) with the remainder of the spring (203) and rod (403) being in the cylinder (635). The ball (405) would squeeze through the cylinder (635) distending the cylinder or ball until the ball entered the joint (605). The turbine (201) would be aligned relative to the platform (411) so the second rod (407) enters the track (607). Upon attaching each component, the bottom faceplate (645) of the turbine (201) will rest in close proximity to the platform (411), although it preferably will not touch it to reduce friction. However, in an alternative embodiment, the bottom faceplate (645) and platform (411) will touch and either component may include a reduced friction surface.

The spring (203) will initially be in the relaxed position of FIG. 5A and the lower openings (611A) of the bottom faceplate (645) will be aligned with the openings (401) in the platform (411). Thus, there is a passageway from under the platform (411), through the holes (401), into the holes (611A) and through the channel (601) and then out the holes (611B). In this position, the second rod (407) will sit inside the track (607) generally at one end thereof and potentially in contact with the sides and/or end of the track (607).

Once the pacing valve (105) has been assembled, the platform (411) is placed on the rim (123) of the bottle (100) with the turbine (201) arranged above the main body (101). The nipple (107) would then be placed on top of the pacing valve (or internal to the connector ring (103)) and the connector ring (103) would be screwed onto the mating threads (113) to secure both the nipple (107) and pacing valve (105) to the main body. It should be recognized that while this arraignment is preferred as it allows the pacing valve to be removable, it is not required and in an alternative embodiment the pacing valve may be constructed to be permanently attached to the main body (101), nipple (107), and/or connector ring (103) such as, but not limited to, by being monolithically constructed with those components or through the use of adhesives or other connecting methods, such as sonic welding.

In operation, when the infant is sucking on the nipple (107) the pacing valve (105) will function in the same manner as a typical turbine known to those of ordinary skill in the art. The velocity of the fluid flow from the main body (101) to the nipple (107) from the infant's suck will drive the turbine (201) to rotate as the fluid passes through the channel (601). This rotation will produce a torque that loads the spring (203) and will also serve to slowly misalign the openings (611A) with the openings (401). The second pin (407) will also traverse the track (607).

As should be apparent, the three openings (611A) of the bottom faceplate allow significant fluid through to the nipple (107) only when at least partially aligned with the openings (401). In the initial open state, fluid flows through the turbine (201). As fluid flow drives the turbine (201) to rotate, fluid flow will be continually restricted due to the continuously increasing misalignment of the openings (611A) and (401) until the force of the sucking action is no longer sufficient to pull fluid through the constricted opening. This position is the closed state of the pacing valve (103) and there is little to no overlap between the open slots (611A) and the slots (401), hence little to no fluid (or more accurately insufficient fluid for the infant to be feeding) can move from the main body (101) to the nipple (107).

The stoppage of the fluid flow in the closed state of the pacing valve (105) cues the infant to stop sucking and swallow and breathe. As the infant ceases sucking, the load on the spring (213) will release its energy and rotate the turbine (201) back to its initial open position at which point fluid will freely flow through the pacing valve (which is now in the open position again) and the process will begin again. The secondary rod (407) and track (607) is provided to prevent the turbine (201) from turning too far if the infant has a particularly strong or persistent sucking action (e.g. they do not breathe until after the pacing valve has been in the closed position for a reasonably substantial amount of time). Such a scenario could result in the turbine (201) rotating to a point where the next turbine hole (611A) aligns with the a different hole (401). Thus, should this scenario occur, the second rod (407) will contact the far end of the track (607) from its starting point and prevent any further motion of the turbine (201). The rod (407) and track (607) can also inhibit the spring (203) from backlashing the turbine (201) past the open position when moving from the closed to open state.

It is understood that an infant may be fatigued from the difficulty to feed using the device as the infant is working against the spring (203) biasing force with every suck. It is not believed that this will cause any harm to the infant, but fatigue and frustration are not ideal as they may hinder the infant in learning proper feeding techniques. This concern is best relieved by altering the spring (203) stiffness to select a spring (203), and therefore pacing valve (105), which has the appropriate force based on the particular infant's suck strength.

It is preferred that the base (205) and turbine (201) be made out of a lightweight plastic with the same or similar properties as the type of plastic used in making baby bottles. This will provide sterility and the ability to be washed in the same manner as the baby bottle. The spring will preferably be made of a non-reactive metal for similar reasons. It is unlikely fluid will be in significant contact with the spring (203) as the spring (203) is essentially encased in the cylinder (635) and blocked by the solid part of the platform (411).

In an embodiment, the base and turbine will both be made of polypropylene or another durable and generally inert material. Polypropylene is a durable plastic commonly used in baby bottles, and thus is known to interact safely with the fluids infants feed on while providing the structural stability required. It is non-toxic, including Bisphenol A (BPA) free, and has a melting point of 160° C., making it sufficient for warming formula before a feeding if desired. It also has a high resistance to stress. Polypropylene is also lightweight, which assists the turbine (201) to rotate given the low flow velocities and pressures encountered during infant feeding. Another significant property of polypropylene which makes it conducive to construction of the base (205) and turbine (201) includes its resistance to many agents, and although there are a few agents that cause it to degrade, such as UV radiation, these agents are not factors that will be encountered by the device during typical use. This resistance allows for the parts to be used for long periods of time, to be dishwasher safe, and to resist degradation from normal use.

The spring (203) is preferably made of Type 316 stainless steel. This is highly resistant to corrosion, making it a safe material for interaction with fluid within the bottle (100) and for cleaning. Alternatively, the spring (203) can be made out of a plastic.

As many infants will eventually pick up on the rhythm of feeding after 4 or 5 repetitions during any given feeding, when an infant begins to start pacing naturally, it can be beneficial to let the infant maintain this pace on their own without the assistance of the device. This will encourage correct feeding behavior. Since initiating feeding can be difficult, it would defeat the purpose to remove the bottle from the infant's mouth to remove the pacing valve (105) if the infant begins to self-pace. In an embodiment, the pacing valve (105) will be capable of being externally shut off during the feeding without disturbing the feeding. In particular, the turbine could be locked into the open position.

In an embodiment, this locking can be provided by a switch near the connector ring (103) which can be used to engage with the turbine (201) and prevent its rotation. Generally, this would be accomplished by providing a connector ring (103) specifically designed for this purpose as the switch would generally need to act through the main body (101), connector ring (103), and/or nipple (107).

Alternatively, there can be provided a frictional or rotational engagement in the turbine (201). In an embodiment of such an arrangement, a ball bearing and slot arrangement could be provided where the bottle (100) has a particular rotation and orientation. In one orientation, the ball bearing is disengaged from the turbine (201) and the turbine (201) may rotate as discussed above. In an alternative arrangement, the bottle (100) itself may be rotated about its axis which will cause the ball bearing to move and frictionally engage the turbine (201) serving to lock it into a particular position.

In a still further embodiment, a latch can also be included to prevent the turbine (201) from spinning, thus turning the device off. The latch could simply move in front of the second rod (407) securing the rod (407) at a fixed point in the track (607) and preventing the turbine (201) from opening. The latch may attach to the platform (411) and be aligned with the track (607). In the unlocked position, the latch will be in the plane of the platform (411), not extending any significant distance into the track (607). In the locked position, the latch will be pointed upwards, going into the track (607), thus preventing the second pin (407) from moving in the track (607).

While the above has discussed a particular system for providing mechanical pacing of an infant feeding while using a pacing valve, there are also described herein two additional alternative embodiments of a pacing system.

In a first embodiment, there is a provided a custom nipple which is a generally a thicker nipple design, in which small tubes connect the nipple opening to the main bottle opening. The outer edge of the nipple follows a standard nipple shape as shown in FIG. 3 with the cylindrical teat extending from a wider base. In this nipple, the inner edge of the nipple is solid silicone, filling the entire inner region of the nipple (the volume of the nipple within the baby bottle). At the end of the teat, a nipple opening allows fluid flow through the tip of the teat to the infant's mouth. The base of the nipple contains a lip which has a larger diameter than the rest of the nipple, to prevent the nipple from coming out of the collar of the baby bottle. From the base of the solid silicone nipple, begin 3-4 hollow cylindrical tubes. Each tube connects to the teat opening, allowing fluid from the bottle, through the openings in the base of the nipple and into the infant's mouth. A chemically safe, silicone material is used, similar to standard infant nipples.

There is then provided a generally cylindrically shaped collar. The inner portion of the lower lip of the collar is designed to screw onto a standard NICU baby bottle. A switch is located on the outer portion of the collar, easily accessible by a NICU nurse to change the state to one of 2-4 finite positions. The switch is easily moved by the thumb of the hand administering the bottle. Within the collar, a thin disc is connected to the switch. The disc aligns perpendicularly with the flow of fluid and is approximately the same diameter as the base of the nipple. It lies extremely close to the base of the nipple. The disc contains an equal number of holes as the number of tubes that connect the teat to the base of the nipple. The switch is connected to the edge of this disc. When the switch is in the off position, the disc rotates to a position so that the holes in the disc do not align with the holes in the base of the nipple, and no fluid may flow through the bottle. From above, the collar has a donut shape, with an inner diameter that is wider than the nipple base diameter, but smaller than the nipple base lip. This allows the nipple to pop into the collar securely.

In this embodiment, the nipple and collar system is designed to allow a nurse to quickly and easily start and stop the flow of fluid to an infant immediately. By intermittently stopping the fluid flow, the infant will be cued to stop sucking, swallow the fluid and breathe, preventing aspiration and other complications. When the infant is ready to suck again the nurse can start the flow of fluid without the nipple leaving the infant's mouth.

To intermittently stop the flow of fluid, the user moves the switch on the outside of the collar. Internally, the switch is connected to the disc, which now rotates to the on position and aligns with the holes in the nipple. The switch can then be switched back to the off position, which rotates the disc to misalign with the holes in the nipple and stop fluid flow. In the off position, the volume of fluid in the nipple would be approximately 1 cc, enough for 1 bolus (1 swallowing iteration) for the premature infant.

In a still further embodiment, there is a floating ball design, where the ball clogs the nipple to prevent fluid flow. The nipple in this design has a standard outer shape shown as in FIG. 3. A standard thickness is used for the silicone nipple. The lip of the base of the nipple secures the nipple in place. A standard collar screws on to a baby bottle and holds the nipple securely in place. A mesh metal cylindrical cage is located in the center of the collar, aligned with the flow of fluid from the bottle to the nipple. The cage acts as a track, for an enclosed floating ball, preventing the ball from leaving the cage. The end of the cage closest to the teat is directly in contact with the inner surface of the nipple. The other end of the cage is free within collar.

On the outer edge of the collar, a switch can be set to 3 positions. The switch is designed to be easily maneuverable by the thumb of the user who is feeding the infant. The 3 positions for the switch are on, off and auto. In the On position fluid is allowed to flow through the bottle. In this state the switch manually moves the ring at the bottom of the cage away from the teat, preventing the ball from stopping fluid flow. In the Off position the switch manually moves the ring at the top of the track towards the teat, to force the ball to prevent fluid flow through the nipple. In the Auto position, neither ring is moved, which allows the ball to float. When the infant sucks, the ball moves with the flow of fluid and is sucked onto the ring near the teat. The ring stops the ball, and clogs the device, preventing flow. Once the infant stops sucking, the ball may once again float away from the ring and allow fluid to flow into the teat.

This lift and clog design incorporates a ball and track system to halt formula flow. In this system a non-reactive mesh metal divider separates the nipple from the rest of the bottle. The divider is located as far away from the nipple end as possible. The mesh allows formula to flow through the divider into the nipple opening. A plastic, air filled ball of about 1 cm diameter is trapped within the mesh nipple portion. The ball floats to the top of the liquid within the bottle (the bottom of the bottle when in the upside down drinking position). When the formula flow velocity is quick enough, the ball will be sucked into the nipple end and plug the flow of milk from reaching the infants mouth. Once the flow has stopped, the infant is cued to breathe and swallow. The formula stops flowing and the ball floats away allowing for future repetitions.

A switch would extend from the base of the nipple cap and have an On and Off position. The switch would be attached to a thin metal rod that obstructed the nipple ending in the Off position so that the ball could not clog the formula flow. Ball in cage check-valve concept. When the infant ceases to suck/breathes, the hollow ball floats to top of cage and the space below the ball fills with liquid. When the infant sucks forcefully enough, the ball will be entrained to seat on the ring and occlude flow. Flight of ball determines bolus volume. The ball in cage/lift and clog mechanism has a base that sits on the neck of the bottle and gets secured in place when the cap is screwed on. There is a cage that sits inside the bottle and attaches to the base. The cage is only (3 or 4) skinny rods in a cylindrical shape, meant to keep the ball in a guided track. The cage's outer diameter is barely smaller than the neck to allow easy insertion of the device, yet large enough to prevent any leaks. By the neck of the bottle, there is a ring of a smaller circumference than the ball. This ring stops the ball, thus clogging the device. The ring is solidly attached to the cage and base components. The ball must match the circumference of the inner cage and be larger than that of the ring. It will be understood that the buoyancy of the ball is key for the proper operation of the device.

In the event that the device gets caught or stuck, thus inhibiting the function of the device or feeding in general, the option to reset the device would further advance the design. This, however, is generally unlikely since the material flowing through the turbine is usually a smooth liquid. Infant formulas are designed to quickly dissolve in water and to not have "lumps" as this can be dangerous in feeding. Thus, the turbine is unlikely to jam (barring a failure of a portion of the device) as there is little for the device to jam on. Further, a jam resulting for damage to a component should result in the devices use being quickly discontinued anyway to prevent any danger.

While the invention has been disclosed in conjunction with a description of certain embodiments, including those that are currently believed to be the preferred embodiments, the detailed description is intended to be illustrative and should not be understood to limit the scope of the present disclosure. As would be understood by one of ordinary skill in the art, embodiments other than those described in detail herein are encompassed by the present invention. Modifications and variations of the described embodiments may be made without departing from the spirit and scope of the invention.

The invention claimed is:

1. A pacing valve for use with a baby bottle, the valve comprising:

a base having a plurality of holes therethrough;

a turbine having a plurality of channels therethrough, said turbine being rotational mounted to said base so that said channels are intermittently aligned and misaligned with said holes; and a spring, said spring biasing said rotational mounting so that said channels are aligned with said holes;

wherein, said pacing valve is placed between a main body and a nipple of a baby bottle;

wherein, an infant sucking on said nipple will move fluid from said main body to said nipple and cause said turbine to rotate relative to said base;

wherein as said turbine rotates from said fluid moving therethrough, said channels become misaligned with said holes;

wherein when said channels are misaligned said fluid flow through said channel ceases; and wherein when said infant ceases sucking, said spring rotates said turbine to align said channels with said holes.

2. A baby bottle for feeding a preterm infant, the bottle comprising:

a main body for holding fluid;

a nipple;

a connector ring; and a pacing valve, said valve including:

a base having a plurality of holes therethrough;

a turbine having a plurality of channels therethrough, said turbine being rotational mounted to said base so that said channels are intermittently aligned and misaligned with said holes; and a spring, said spring biasing said rotational mounting so that said channels are aligned with said holes;

wherein, said pacing valve is placed between said main body and said nipple and said pacing valve and said nipple are attached to said main body by said connector ring such that an infant sucking on said nipple will move fluid from said main body to said nipple and will cause said turbine to rotate relative to said base;

wherein as said turbine rotates from said fluid moving therethrough, said channels become misaligned with said holes;

wherein when said channels are misaligned said fluid flow through said channel ceases; and wherein when said infant ceases sucking, said spring rotates said turbine to align said channels with said holes.

* * * * *